US008662961B2

(12) United States Patent
Maruoka et al.

(10) Patent No.: US 8,662,961 B2
(45) Date of Patent: Mar. 4, 2014

(54) POLISHING PAD SEASONING METHOD, SEASONING PLATE, AND SEMICONDUCTOR POLISHING DEVICE

(75) Inventors: Daisuke Maruoka, Nagasaki (JP); Koudai Moroiwa, Nagasaki (JP)

(73) Assignee: Sumco Techxiv Corporation, Nagasaki (JP)

( * ) Notice: Subject to any disclaimer, the term of this patent is extended or adjusted under 35 U.S.C. 154(b) by 1162 days.

(21) Appl. No.: 12/607,259

(22) Filed: Oct. 28, 2009

(65) Prior Publication Data

US 2010/0105295 A1 Apr. 29, 2010

(30) Foreign Application Priority Data

Oct. 29, 2008 (JP) ..... 2008-278683

(51) Int. Cl.
*B24B 1/00* (2006.01)

(52) U.S. Cl.
USPC ..... 451/56; 451/443; 451/287; 451/288; 451/290

(58) Field of Classification Search
USPC ..... 451/56, 443, 285, 287, 288, 290
See application file for complete search history.

(56) References Cited

U.S. PATENT DOCUMENTS

| | | | | |
|---|---|---|---|---|
| 5,885,137 | A * | 3/1999 | Ploessl | 451/56 |
| 6,004,196 | A * | 12/1999 | Doan et al. | 451/443 |
| 6,347,981 | B1 * | 2/2002 | Holzapfel | 451/56 |
| 6,358,121 | B1 * | 3/2002 | Zuniga | 451/41 |
| 6,371,838 | B1 * | 4/2002 | Holzapfel | 451/72 |
| 6,435,949 | B1 * | 8/2002 | Katsuoka et al. | 451/59 |
| 6,530,827 | B2 * | 3/2003 | Mitsuhashi | 451/72 |
| 7,479,204 | B2 | 1/2009 | Miyazaki et al. | |
| 7,510,463 | B2 * | 3/2009 | Kim et al. | 451/56 |
| 7,597,608 | B2 * | 10/2009 | Chang et al. | 451/56 |
| 7,901,267 | B1 * | 3/2011 | Benner | 451/5 |
| 8,398,466 | B2 * | 3/2013 | Sung et al. | 451/443 |
| 2007/0287367 | A1 * | 12/2007 | Kim et al. | 451/527 |

FOREIGN PATENT DOCUMENTS

| | | |
|---|---|---|
| JP | 06-015563 | 1/1994 |
| JP | 3-159928 | 7/1998 |
| JP | 2000-024915 | 1/2000 |
| JP | 2000-326205 | 11/2000 |
| JP | 2002-208575 | 7/2002 |
| JP | 2003-151934 | 5/2003 |
| JP | 2005-005388 | 1/2005 |
| JP | 2006-117775 | 5/2006 |

OTHER PUBLICATIONS

English language Translation of JP 10-180640, corresponding to JP 3159928.
Japan Office action, mail date is Mar. 26, 2013.

* cited by examiner

*Primary Examiner* — Eileen P. Morgan
(74) *Attorney, Agent, or Firm* — Greenblum & Bernstein, P.L.C.

(57) ABSTRACT

A seasoning plate is placed on a polishing pad and performs seasoning of the polishing pad by abrading the polishing pad through the friction caused by rotation of the polishing pad. The seasoning plate includes: conditioners that abrade the polishing pad; a round flexible substrate that has the conditioners attached to the lower face thereof; an O-ring that is placed on the upper face of the flexible substrate, the O-ring forming a circle concentric with the flexible substrate; and a weight plate serving as a weight portion that is placed on the O-ring and applies weight for deforming the flexible substrate.

23 Claims, 12 Drawing Sheets

RELATED ART

POLISHING PAD SEASONING METHOD, SEASONING PLATE, AND SEMICONDUCTOR POLISHING DEVICE

BACKGROUND (a) Field of the Invention

The present invention relates to a semiconductor polishing technique, and more particularly, to a semiconductor polishing technique by which a semiconductor wafer is brought into contact with a polishing pad.

(b) Description of the Related Art

Conventionally, a material wafer for manufacturing a semiconductor device is formed by growing a single-crystal semiconductor ingot of silicon or the like by the Czochralski method (CZ method) or the floating zone method (FZ method), abrading and shaping the outer periphery of the semiconductor ingot with the use of a cylindrical grinding machine or the like, and slicing the semiconductor ingot with a wire saw in a slicing process. After that, chamfering is performed on the wafer peripheral portions, and flattening and etching are also performed in a wrapping process. Primary polishing (rough polishing) and secondary polishing (finishing) are then performed to form a mirror wafer.

Circuits are formed on the surface of the mirror wafer obtained through the above-mentioned procedures, so as to form a semiconductor device. However, if the surface flatness of the wafer manufactured through the above-described procedures is low, part of the lens used in the exposure in a photolithography process for forming circuits does not come into focus, and it becomes difficult to form a minute circuit pattern.

Therefore, a very high degree of flatness is required in today's high-precision device manufacture. In the manufacture of wafers having a high degree of flatness, the wafer surface polishing is essential. As a polishing device for performing wafer surface polishing, a batch-type one-side polishing device has been widely known.

FIGS. 10-1 and 10-2 show an example of the batch-type one-side polishing device (see Japanese Patent Application Laid-Open (JP-A) No. 2006-117775). FIG. 10-1 is a vertical cross-sectional view of the batch-type one-side polishing device. FIG. 10-2 is an enlarged cross-sectional view of essential components of the batch-type one-side polishing device. The batch-type one-side polishing device is a device that polishes only one side of each of the wafers in one polishing operation, and is capable of polishing more than one wafer at the same time.

In FIGS. 10-1 and 10-2, the batch-type one-side polishing device 100 includes: a disk-like fixed platen 102 that is capable of rotating in a predetermined direction (counterclockwise when seen from above, for example); a polishing pad 104 that is formed with unwoven fabric or urethane foam bonded onto the surface of the fixed platen 102; polishing heads 108 that are placed above the polishing pad 104 and rotate about supporting axes 106; carrier plates 110 that are placed under the lower faces of the polishing heads 108; templates 112 that are fixed under the lower faces of the carrier plates 110 and hold wafers W with wafer positioning holes 112*a*; and a slurry tube 114 that supplies slurry to the surface of the polishing pad 104.

Each of the carrier plates 110 is the carrier for holding wafers, and is formed with porous resin such as polyurethane-resin porous solid. Each of the templates 112 is formed with glass epoxy resin, a polycarbonate sheet, a polyester sheet, or the like. Each of the templates 112 has five wafer positioning holes 112*a* for holding five wafers W. As shown in FIG. 10-2, the diameter of each of the wafer positioning holes 112*a* is larger than the wafer diameter. When the polishing heads 108 rotate, the wafers W freely rotate inside the wafer positioning holes 112*a*.

In the batch-type one-side polishing device 100 shown in FIGS. 10-1 and 10-2, the templates 112 are provided to the carrier plates 110, so as to allow the wafers W to freely rotate. However, instead of the templates 112, an adhesive agent or wax may be used to bond and fix the wafers W to the lower faces of the carrier plates 110.

Since chips generated during polishing operations and slurry abrasive grains remain on the polishing pad, the polishing pad deteriorate, and the wafer polishing efficiency drops rapidly, as the wafer polishing operations continue. More specifically, since the surface of the polishing pad becomes too smooth, the slurry retention rate (slurry remaining rate) becomes lower. As a result, the slurry does not spread evenly on the polishing pad, and this phenomenon causes variations of wafer surface polishing conditions and a decrease in wafer polishing removal efficiently.

To counter this problem, seasoning is performed to recover the slurry retention, where the smoothened surface of the polishing pad is put into almost an initial state. A semiconductor polishing device having a center roller at the center of a polishing pad is now described as an example. As illustrated in FIG. 11-1, a semiconductor polishing device 200 has an urethane-foam polishing pad 206 bonded onto a round platen 204 that rotates coaxially with a center roller 202. The platen 204 rotates in the opposite direction (counterclockwise) from the rotation direction of the center roller 202 that rotates clockwise. Silicon wafers 210 having its polished surface facing downward are bonded to the lower face of a polishing plate 208 with wax. The polishing plate 208 has a smaller diameter than the radiuses of the platen 204 and the polishing pad 206. The side face of the polishing plate 208 is brought into contact with the side face of the center roller 202. A weight portion for facilitating the polishing of the silicon wafers 210 is placed on the polishing plate 208, or weight is applied onto the upper face of the polishing plate 208, so as to press the silicon wafers 210 against the polishing pad 206. While slurry (not shown) is supplied onto the polishing pad 206, the polishing pad 206 is rotated, and the polishing plate 208 is rotated counterclockwise by the friction caused by the rotation of the center roller 202. The surfaces of the silicon wafers 210 are polished by the friction caused between the silicon wafers 210 and the polishing pad 206 (or the abrasive grains in the slurry) by the rotation of the polishing pad 206 and the polishing plate 208. A ring-like conditioner (also called a dresser) 212 having an electrodeposited diamond grindstone is attached to a rotating member 214, and, like the polishing plate 208, the rotating member 214 is placed on the polishing pad 206. The rotating member 214 is rotated counterclockwise, to perform toothing on the surface of the polishing pad 206. In this manner, seasoning is performed. The seasoning is performed not only in the rough polishing process, but also in the CMP (Chemical Mechanical Polishing) process at a later stage (see JP-A No. 2002-208575 and 2003-151934).

However, if the seasoning with the use of the conditioner is repeated, the inner circumferential region 206*a* and the outer circumferential region 206*c* of the polishing pad 206 are selectively abraded. FIG. 11-2 illustrates this phenomenon more specifically. Where the abscissa axis indicating the moving radial direction of the polishing pad 206, and the ordinate axis indicates the abrasion depth in the polishing pad 206, deeper abrasion is observed in the inner circumferential region 206*a* and the outer circumferential region 206*c*, and the curve in FIG. 11-2 becomes a convex curve.

When a silicon wafer is polished with the use of a polishing pad having a shape represented by such a convex curve, the flatness of the surface of each silicon wafer becomes poorer, and more polishing is performed on the side of the silicon wafer positioned in the inner circumferential region of the polishing pad than on the side of the silicon wafer positioned in the outer circumferential region of the polishing pad. This phenomenon is called "inner abrasion". This inner abrasion can be eliminated by lowering the rotation speed of the polishing pad. However, when the rotation speed becomes lower, the polishing efficiency also becomes lower. If the rotation speed of the polishing pad is lowered, "outer abrasion" might be observed, as opposed to the inner abrasion. However, depending on the surface condition of the polishing pad, a silicon wafer might have either inner abrasion or outer abrasion, even if the polishing pad is rotated at a fixed rotation speed. Therefore, it is difficult to control the flatness of the polished surface of each silicon wafer by adjusting the rotation speed of the polishing pad.

To solve this problem, JP-A No. 2003-151934 discloses a structure that controls the position of the polishing-pad seasoning conditioner on the polishing pad, and maintains the flatness of the polishing pad. However, this structure requires a mechanism for controlling the conditioner placed on the polishing pad. As a result, the structure becomes complicated, and the costs become higher. As shown in FIG. 12, Japanese Patent Publication No. 3,159,928 discloses a structure in which a quatrefoil hole 306 is formed in the lower face 302 of a conditioner 300 that has diamond abrasive grains 304 dispersed on the lower face 302 in contact with a polishing pad. The conditioner 300 is designed to flatten the polishing pad. In this structure, the efficiency of the seasoning of the polishing pad is increased in the inner circumferential region of the conditioner 300, and the polishing pad is flattened. However, unlike a conventional ring-like conditioner, the conditioner 300 has a complicated structure, resulting in higher costs.

SUMMARY OF THE INVENTION

In view of the above problems, the present invention aims to provide a seasoning method, a seasoning plate, and a semiconductor polishing device that can recover the flatness of a polishing pad with a simple structure, and can readily control the flatness of the polished surface by adjusting the rotation speed of the polishing pad.

To achieve the above objective, a first aspect of a polishing pad seasoning method according to the present invention is characterized as a polishing pad seasoning method for abrading a polishing pad by the friction caused by rotation of the polishing pad, the method including: attaching conditioners for abrading the polishing pad to the lower face of a round flexible substrate; and applying weight for deforming the flexible substrate to the flexible substrate from a ring placed on the upper face of the flexible substrate, the ring forming a circle concentric with the flexible substrate.

A second aspect of the polishing pad seasoning method according to the present invention is characterized as a polishing pad seasoning method for abrading a polishing pad by the friction caused by rotation of the polishing pad, the method including: attaching conditioners for abrading the polishing pad to the lower face of a round flexible substrate; mounting a weight portion on the upper face of the flexible substrate, to press the conditioners against the polishing pad; and applying weight for deforming the flexible substrate to the flexible substrate by a ring placed between the flexible substrate and the weight portion, to eliminate inflection points in the pad surface of the polishing pad, the inflection points appearing during the abrasion of the polishing pad by the conditioners, the ring forming a circle concentric with the flexible substrate.

A third aspect of the polishing pad seasoning method according to the present invention is characterized in that the conditioners are arranged in such a manner that the centers of the conditioners form a circle concentric with the flexible substrate.

A fourth aspect of the polishing pad seasoning method according to the present invention is characterized in that grooves extending along radial lines extending from the center of each of the conditioners are formed in the surface of each of the conditioners, the surface being in contact with the polishing pad.

A first aspect of a seasoning plate according to the present invention is characterized as a seasoning plate that is placed on a polishing pad and performs seasoning of the polishing pad by abrading the polishing pad through the friction caused by rotation of the polishing pad, the seasoning plate including: conditioners that abrade the polishing pad; a round flexible substrate that has the conditioners attached to the lower face thereof; a ring that is placed on the upper face of the flexible substrate, the ring forming a circle concentric with the flexible substrate; and a weight portion that is placed on the ring and applies weight for deforming the flexible substrate.

A second aspect of the seasoning plate according to the present invention is characterized as a seasoning plate that is placed on a polishing pad and performs seasoning of the polishing pad by abrading the polishing pad through the friction caused by rotation of the polishing pad, the seasoning plate including: conditioners that abrade the polishing pad; a round flexible substrate that has the conditioners attached to the lower face thereof; a weight portion that applies weight to the flexible substrate; and a ring that is placed between the flexible substrate and the weight portion, and applies weight for deforming the flexible substrate to the flexible substrate, the ring forming a circle concentric with the flexible substrate, the ring eliminating inflection points in the pad surface of the polishing pad, the inflection points appearing during the abrasion of the polishing pad by the conditioners.

A third aspect of the seasoning plate according to the present invention is characterized in that the conditioners are arranged in such a manner that the centers of the conditioners form a circle concentric with the flexible substrate.

A fourth aspect of the seasoning plate according to the present invention is characterized in that grooves extending along radial lines extending from the center of each of the conditioners are formed in the surface of each of the conditioners, the surface being in contact with the polishing pad.

A fifth aspect of the seasoning plate according to the present invention is characterized in that the material of the flexible substrate is polyvinyl chloride.

A sixth aspect of the seasoning plate according to the present invention is characterized in that the material of the ring is silicon rubber or resin.

A seventh aspect of the seasoning plate according to the present invention is characterized as a seasoning plate that is placed on a polishing pad and performs seasoning of the polishing pad by abrading the polishing pad through the friction caused by rotation of the polishing pad, the seasoning plate including: conditioners that abrade the polishing pad; a round flexible substrate that is made of polyvinyl chloride and has the conditioners attached to the lower face thereof; grooves that extend along radial lines extending from the center of each of the conditioners, and are formed in the surface of each of the conditioners, the surface being in contact with the polishing pad; a ring that is made of silicon rubber or resin, and is placed on the upper face of the flexible substrate, the ring forming a circle concentric with the flexible substrate; and a weight portion that is placed on the ring and applies weight for deforming the flexible substrate.

An eighth aspect of the seasoning plate according to the present invention is characterized as a seasoning plate that is placed on a polishing pad and performs seasoning of the polishing pad by abrading the polishing pad through the friction caused by rotation of the polishing pad, the seasoning plate including: conditioners that abrade the polishing pad; a round flexible substrate that is made of polyvinyl chloride and has the conditioners attached to the lower face thereof; grooves that extend along radial lines extending from the center of each of the conditioners, and are formed in the surface of each of the conditioners, the surface being in contact with the polishing pad; a weight portion that applies weight to the flexible substrate; and a ring that is made of silicon rubber or resin, and is placed between the flexible substrate and the weight portion, the ring forming a circle concentric with the flexible substrate, the ring applying weight for deforming the flexible substrate to the flexible substrate, the ring eliminating inflection points in the pad surface of the polishing pad, the inflection points appearing during the abrasion of the polishing pad by the conditioners.

A ninth aspect of the seasoning pad according to the present invention is characterized in that the conditioners of the seventh and eighth aspects are arranged in such a manner that the centers of the conditioners form a circle concentric with the flexible substrate.

A first aspect of a semiconductor polishing device according to the present invention is characterized as a semiconductor polishing device on which a seasoning plate can be mounted, the seasoning plate being placed on a polishing pad and performing seasoning of the polishing pad by abrading the polishing pad through the friction caused by rotation of the polishing pad, the seasoning plate including: conditioners that abrade the polishing pad; a round flexible substrate that has the conditioners attached to the lower face thereof; a ring that is placed on the upper face of the flexible substrate, the ring forming a circle concentric with the flexible substrate; and a weight portion that is placed on the ring and applies weight for deforming the flexible substrate.

A second aspect of the semiconductor polishing device according to the present invention is characterized as a semiconductor polishing device on which a seasoning plate can be mounted, the seasoning plate being placed on a polishing pad and performing seasoning of the polishing pad by abrading the polishing pad through the friction caused by rotation of the polishing pad, the seasoning plate including: conditioners that abrade the polishing pad; a round flexible substrate that has the conditioners attached to the lower face thereof; a weight portion that applies weight to the flexible substrate; and a ring that is placed between the flexible substrate and the weight portion, and applies weight for deforming the flexible substrate to the flexible substrate, the ring forming a circle concentric with the flexible substrate, the ring eliminating inflection points in the pad surface of the polishing pad, the inflection points appearing during the abrasion of the polishing pad by the conditioners.

A third aspect of the semiconductor polishing device according to the present invention is characterized in that the conditioners are arranged in such a manner that the centers of the conditioners form a circle concentric with the flexible substrate.

A fourth aspect of the semiconductor polishing device according to the present invention is characterized in that grooves extending along radial lines extending from the center of each of the conditioners are formed in the surface of each of the conditioners, the surface being in contact with the polishing pad.

A fifth aspect of the semiconductor polishing device according to the present invention is characterized in that the material of the flexible substrate is polyvinyl chloride.

A sixth aspect of the semiconductor polishing device according to the present invention is characterized in that the material of the ring is silicon rubber or resin.

A seventh aspect of the semiconductor polishing device according to the present invention is characterized as a semiconductor polishing device on which a seasoning plate can be mounted, the seasoning plate being placed on a polishing pad and performing seasoning of the polishing pad by abrading the polishing pad through the friction caused by rotation of the polishing pad, the seasoning plate including: conditioners that abrade the polishing pad; a round flexible substrate that is made of polyvinyl chloride and has the conditioners attached to the lower face thereof; grooves that extend along radial lines extending from the center of each of the conditioners, and are formed in the surface of each of the conditioners, the surface being in contact with the polishing pad; a ring that is made of silicon rubber or resin, and is placed on the upper face of the flexible substrate, the ring forming a circle concentric with the flexible substrate; and a weight portion that is placed on the ring and applies weight for deforming the flexible substrate.

An eighth aspect of the semiconductor polishing device according to the present invention is characterized as a semiconductor polishing device on which a seasoning plate can be mounted, the seasoning plate being placed on a polishing pad and performing seasoning of the polishing pad by abrading the polishing pad through the friction caused by rotation of the polishing pad, the seasoning plate including: conditioners that abrade the polishing pad; a round flexible substrate that is made of polyvinyl chloride and has the conditioners attached to the lower face thereof; grooves that extend along radial lines extending from the center of each of the conditioners, and are formed in the surface of each of the conditioners, the surface being in contact with the polishing pad; a weight portion that applies weight to the flexible substrate; and a ring that is made of silicon rubber or resin, and is placed between the flexible substrate and the weight portion, the ring forming a circle concentric with the flexible substrate, the ring applying weight for deforming the flexible substrate to the flexible substrate, the ring eliminating inflection points in a pad surface of the polishing pad, the inflection points appearing during the abrasion of the polishing pad by the conditioners.

A ninth aspect of the semiconductor polishing device according to the present invention is characterized in that the conditioners are arranged in such a manner that the centers of the conditioners form a circle concentric with the flexible substrate.

With the polishing pad seasoning method, the seasoning plate, and the semiconductor polishing device according to the present invention, the variations in abrasion depth in the inner circumferential region and the outer circumferential region of polishing pad can be reduced with a simple structure, while using conventional conditioners. Also, appearance of inflection points in the pad surface of the polishing pad due to the conditioners can be prevented, and the variations in abrasion depth of the polishing pad can be made uniform. In this manner, the flatness of the polished surface can be readily maintained by controlling the rotation speed of the polishing pad. Thus, the duration of use (the life) of the polishing pad can be prolonged, and costs can be lowered.

BRIEF DESCRIPTION OF THE DRAWINGS

FIG. 1-2 is a partial cross-sectional view of the structure shown in FIG. 1-1;

FIG. 1-3 is a plan view of the structure shown in FIG. 1-1;

FIG. 2-1 illustrates the conditioners used in this embodiment;

FIG. 2-2 illustrates one of the conditioners used in this embodiment;

FIG. 3-1 is a schematic view showing the shape of the pad surface of the polishing pad observed when ring-like conditioners are used;

FIG. 3-2 shows the GBIR of the surface polished by the polishing pad shown in FIG. 3-1;

FIG. 4-1 shows the polishing pad displacement observed when the center region of the polishing pad is abraded;

FIG. 4-2 shows the GBIR of the surface polished by the polishing pad shown in FIG. 4-1;

FIG. 5-1 is a schematic view showing the shape of a seasoning plate formed by attaching conditioners to a ceramic plate;

FIG. 5-2 shows the abrasion amount observed when a polishing pad is abraded with the use of the seasoning plate shown in FIG. 5-1;

FIG. 6-1 shows the shape of the pad surface of a polishing pad observed when the polishing pad is abraded with the use of the seasoning plate shown in FIG. 5-1;

FIG. 6-2 shows the GBIR of the surface polished with the use of the polishing pad shown in FIG. 6-1;

FIG. 6-3 shows the GFLR of the surface polished with the use of the polishing pad shown in FIG. 6-1;

FIG. 8-1 is a schematic view of a structure in which the inner circumferential region and the outer circumferential region of a polishing pad are selectively abraded;

FIG. 8-2 shows the GFLR of the polished surface of the wafer polished by the polishing pad shown in FIG. 8-1;

FIG. 9-1 shows the shape of the pad surface of a polishing pad observed when the polishing pad is abraded with the use of a seasoning plate according to this embodiment;

FIG. 9-2 shows the GBIR of the surface polished with the use of the polishing pad shown in FIG. 9-1;

FIG. 9-3 shows the changes in the GFLR of the surface polished with the use of the polishing pad shown in FIG. 9-1;

FIG. 10-1 is a vertical cross-sectional view of a conventional semiconductor polishing device of a batch type;

FIG. 10-2 is an enlarged cross-sectional view of the essential components shown in FIG. 10-1;

FIG. 11-1 is a schematic view of a conventional semiconductor polishing device;

FIG. 11-2 shows the shape of the pad surface of the polishing pad of the semiconductor polishing device shown in FIG. 11-1.

DETAILED DESCRIPTION OF EMBODIMENTS

The following is a description of an embodiment of a polishing pad seasoning method, a seasoning plate, and a semiconductor polishing device according to the present invention, with reference to the accompanying drawings. The components and the types, combinations, shapes, and relative positions of the components described in the embodiment are merely examples and do not restrict the scope of the invention to those examples, unless otherwise specified.

Figure 1:
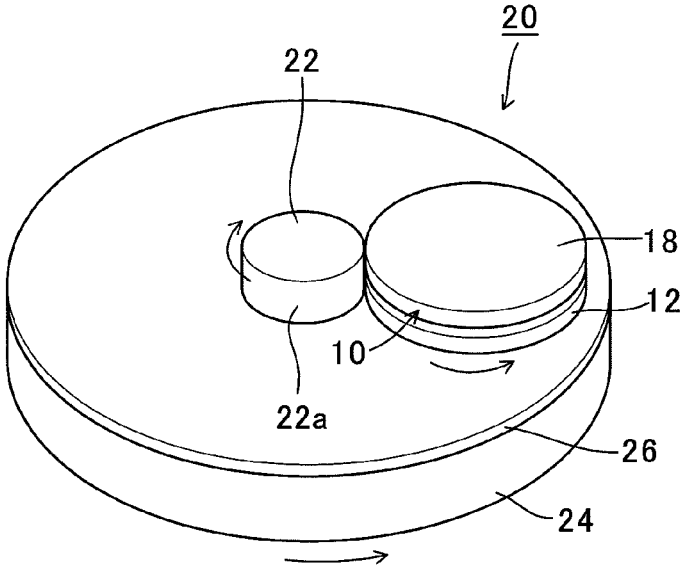
FIG. 1-1 is a perspective view of a seasoning plate and a semiconductor polishing device according to an embodiment of the present invention.
Figures 1, 2:
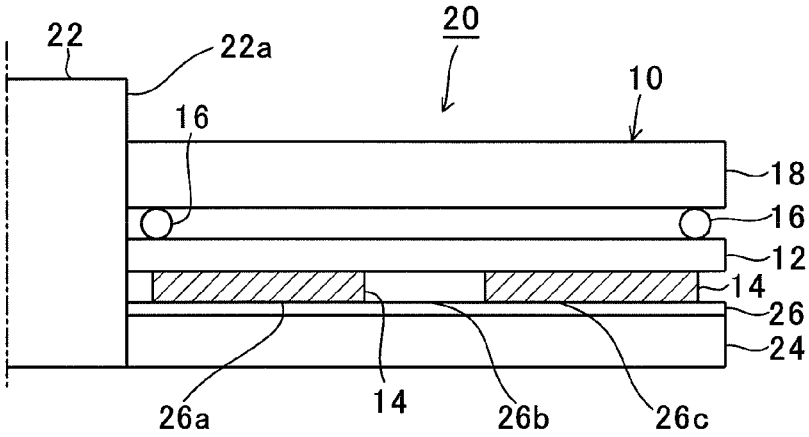
Figures 1, 2, 3:
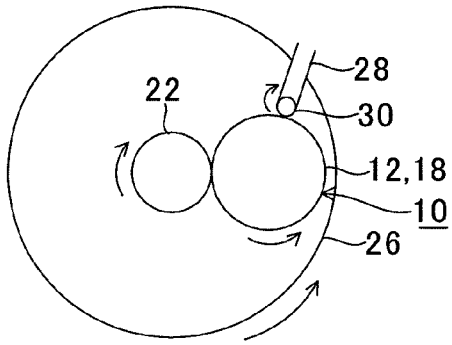
Figures 1, 2:
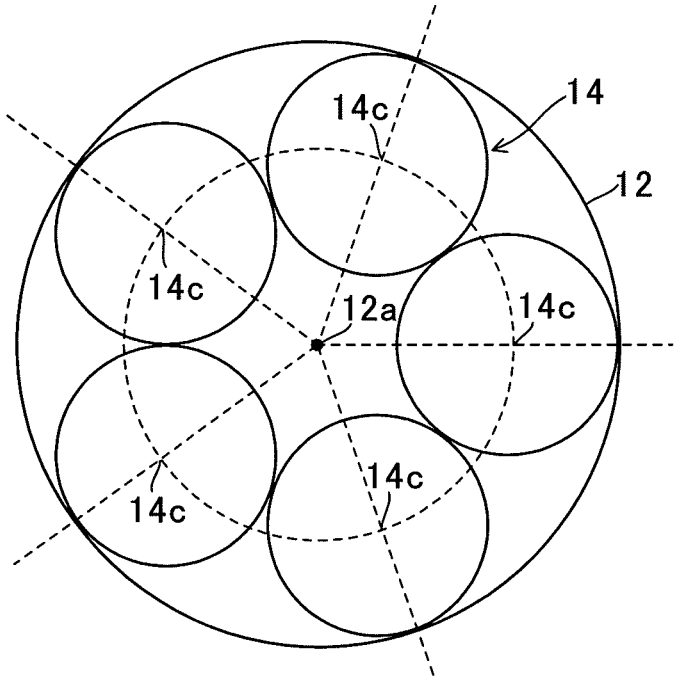
Figure 2:
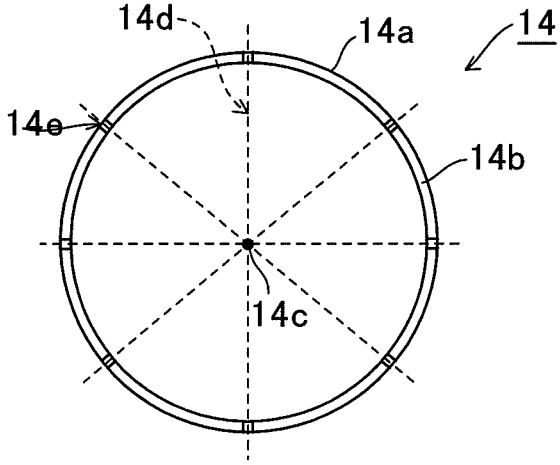
Figures 1, 3:
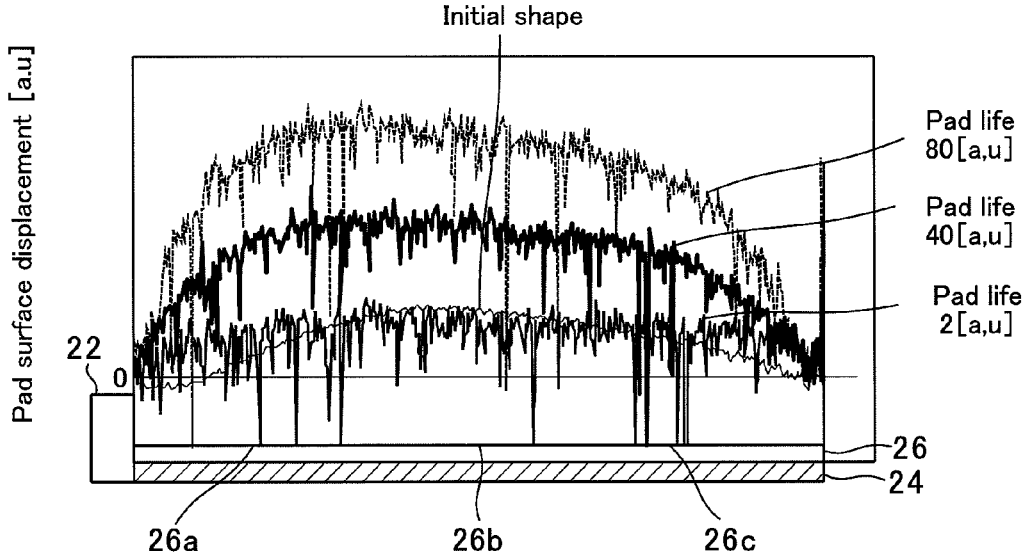
Figures 2, 3:
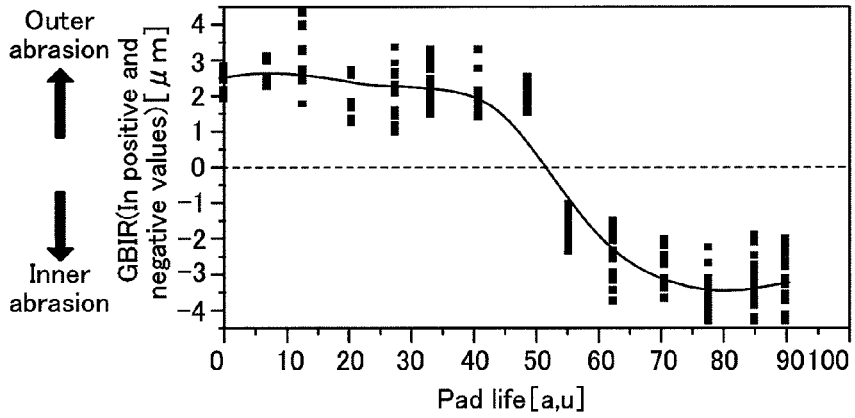

FIG. 1-1 is a perspective view of a seasoning plate and a semiconductor polishing device according to this embodiment. FIG. 1-2 is a partial cross-sectional view of the structures shown in FIG. 1-1, and FIG. 1-3 is a plan view of the structures shown in FIG. 1-1. By a polishing pad seasoning method according to this embodiment, a polishing pad is ground by the friction caused by rotating the polishing pad. Conditioners for grinding the polishing pad are attached to the bottom face of a round flexible substrate, and a ring that is concentric with the flexible substrate is placed on the upper face of the flexible substrate. Weight for deforming the flexible substrate is applied onto the ring. As a result, a seasoning plate 10 is formed. The seasoning plate 10 includes a flexible substrate 12, conditioners 14, an O-ring 16, and a weight plate 18 serving as a weight portion. A semiconductor polishing device 20 has a fundamental structure in which a polishing pad 26 made of urethane foam is attached to a round-shape fixed platen 24 that is coaxial with a rotating center roller 22 and can have a rotation speed adjusted independently of the center roller 22. This embodiment is to be applied to the polishing pad that is used in primary polishing (rough polishing) of the surface of each silicon wafer after the processes for wrapping and etching the silicon wafers cut out of ingot.

The flexible substrate 12 is formed with a flexible material such as polyvinyl chloride (hereinafter referred to as PVC). The flexible substrate 12 is a round-shape substrate that has a certain thickness, and has a diameter smaller than the radius of the polishing pad 26. This flexible substrate 12 can be deformed by weight applied from the later described weight plate 18 serving as a weight portion.

FIG. 2-1 and FIG. 2-2 illustrate the conditioners 14. As shown in FIG. 2-1, the conditioners 14 that have ring-like shapes or ashtray-like shapes are attached to the bottom face of the flexible substrate 12. The conditioners 14 have diamond abrasive grains or the like electrodeposited onto their surfaces, and each have a diameter smaller at least than the radius of the flexible substrate 12. As shown in FIG. 2-2, a ring-like bank 14*a* is formed on the outer circumferential region on the opposite face of each conditioner 14 from the face to be attached to the flexible substrate 12. The ring face 14*b* of the bank 14*a* is to be brought into contact with the polishing pad 26. In the ring face 14*b*, grooves 14*e* are formed at locations where lines 14*d* extending radially from the center 14*c* of the conditioner 14 across the ring face 14*b*. In this embodiment, eight grooves 14*e* are formed to divide the ring face 14*b* into eight. As shown in FIG. 2-1, the conditioners 14 are attached to the bottom face of the flexible substrate 12. In this embodiment, five conditioners 14 are attached to the bottom face of the flexible substrate 12 in such a manner as to form a circle concentric with the flexible substrate 12.

The O-ring 16 is placed on the upper face of the flexible substrate 12 in such a manner as to form a circle concentric with the outer circumference of the flexible substrate 12. The round weight plate 18 serving as the weight portion has the same diameter as the flexible substrate 12, and is placed on the O-ring 16. The weight plate 18 applies weight onto the flexible substrate 12 via the O-ring 16, and presses the conditioners 14 against the polishing pad by the weight. It is preferable that the weight plate 18 is made of ceramics. On the other hand, any material may be used for the flexible substrate 12, and a metal or the like may be used, as long as the predetermined weight can be applied to the flexible substrate 12. It is preferable that the O-ring 16 is made of silicon rubber. However, any other material such as resin may be used, as long as the weight plate 18 can be held by the friction, that is, the weight plate 18 and the O-ring 16 do not deviate from each other due to the later described rotation of the seasoning plate 10.

The seasoning plate 10 having the above structure has the conditioners 14 that face the polishing pad 26 and are in contact with the polishing pad 26 of the semiconductor polishing device 20. The side faces of the flexible substrate 12 and the weight plate 18 of the seasoning plate 10 are brought into contact with the side face of the center roller 22 of the semiconductor polishing device 20 rotating clockwise. Subjected to the friction with the side face 22*a* of the center roller 22 and the counterclockwise rotation from the center roller 22, the seasoning plate 10 (the flexible substrate 12 and the weight plate 18) rotates counterclockwise in the opposite direction from the direction of rotation of the center roller 22. Although rotating coaxially with the center roller 22, the polishing pad 26 is capable of rotating counterclockwise, independently of the rotation of the center roller 22. As shown in FIG. 1-3, the seasoning plate 10 is held by the contact between a rotational contact roller 30 fixed at the top end of an arm 28 extending toward the seasoning plate 10 from the opposite direction from the direction of rotation of the polishing pad 26 and the side faces of the flexible substrate 12 and the weight plate 18. Held in that position, the seasoning plate 10 is in rotational contact with the center roller 22 and the rotational contact roller 30, and rotates counterclockwise, with its axis of rotation being the center of the flexible substrate 12 and the weight plate 18. Here, the wafer to be polished such as a silicon wafer (not shown) and the polishing plate (not shown) have the same arrangement and structures as those of the conventional art, and therefore, explanation of them is omitted herein.

Next, the background to the development of the structure and the effects and advantages of the seasoning plate 10 according to this embodiment are described.

FIG. 3-1 shows the shapes of the pad surface of the polishing pad in predetermined "pad lives". Here, a "pad life" means a polishing time of the polishing pad. The pad shapes are indicated by the displacement from the best-fit surface of an inner circumference region 26*a* of the polishing pad 26, and the pad shapes of the polishing pad shown in the other drawings are also shown in the same manner, unless otherwise specified. The "best-fit surface" is a virtual surface in which the later described GFLR becomes smallest. As shown in FIG. 3-1, as the pad life passes, deeply ground portions appear in the inner circumferential region 26*a* and the outer circumferential region 26*c* of the polishing pad 26, and convex pad face portions are formed in the inner circumferential region 26*a* and the outer circumferential region 26*c* across the center region 26*b*. In this case, the surface polished by the polishing pad 26 tends to have abrasion in the inner circumferential region.

FIG. 3-2 shows the relationship between the pad life and the GBIR of the polished surface plotted in a graph. Here, GBIR (Global Back-side Ideal Range) is used to evaluate the flatness of the polished surface, with the back surface of the polished surface of the polished wafer being the reference surface. Normally, the GBIR does not indicate a negative value. However, FIG. 3-2 shows both positive and negative values, based on the GBIR index to check variations in flatness. More specifically, the value of the GBIR is adjusted so that the polished surface has abrasion in the outer circumferential region when the GBIR indicates a positive value, and the polished surface has abrasion in the inner circumferential region when the GBIR indicates a negative value. The surface polishing is performed, with the rotation speed of the polishing pad 26 being fixed at 21 rpm, and the polishing time being 10 minutes. It becomes apparent from the observation result that the abrasion of the polished surface switches from the outer circumferential region to the inner circumferential region when the pad life first exceeds a certain period of time.

Figures 1, 4:
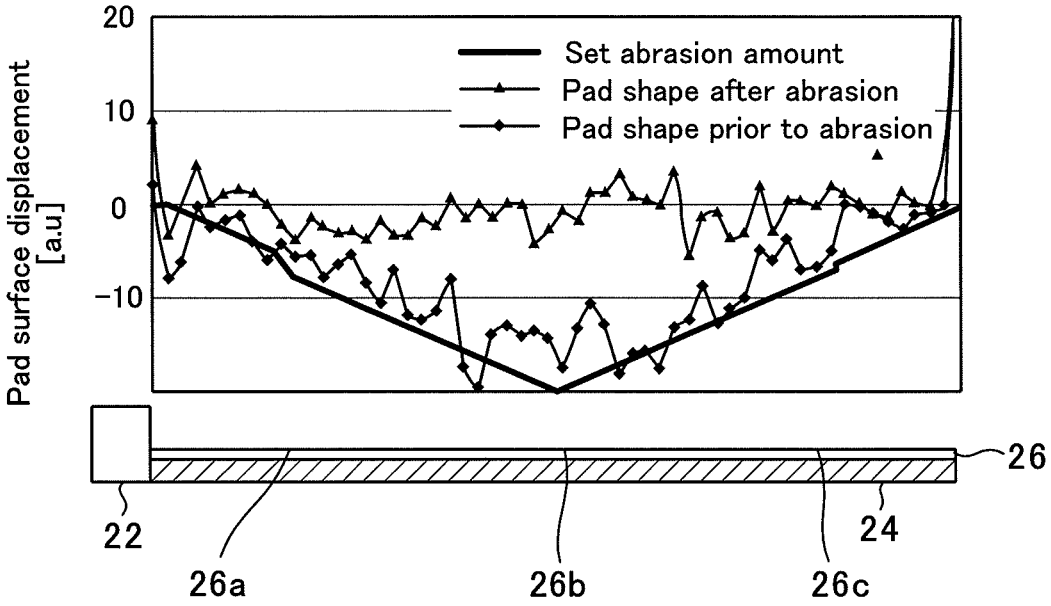
Figures 2, 4:
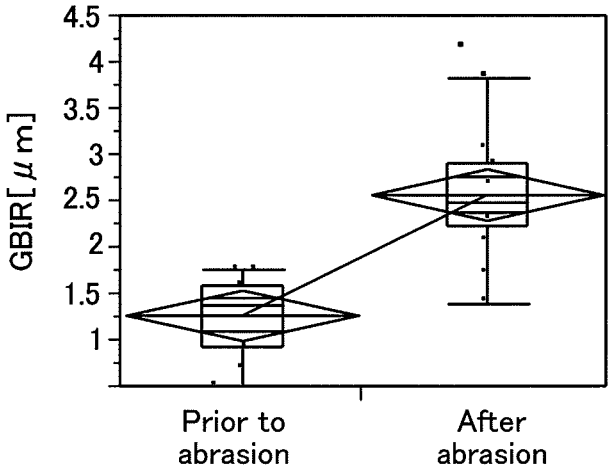

FIG. 4-1 shows the polishing pad displacement observed when the center region 26*b* of a polishing pad is abraded. FIG. 4-2 shows the GBIR of the surface polished with the use of the polishing pad shown in FIG. 4-1. As shown in FIG. 4-1, the inventor formed a polishing pad that had a concave portion extending from the inner circumferential region to the outer circumferential region across the center region, with the use of conditioners. As shown in FIG. 4-2, the GBIR of the polished surface of the polished wafer was measured and plotted in a graph. A polishing pad almost in an initial state was prepared, and the center region of the polishing pad was abraded at the rotation speed of 45 rpm. The rotation speed of the polishing pad and the center roller 22 before and after the abrasion in the polishing process was set at 21 rpm, and the polishing time of the polished wafer was set at 10 minutes. It became apparent that the surface polished by the polishing pad 26 after the abrasion had a higher GBIR value and greater outer-circumferential abrasion than the surface polished by the polishing pad 26 before the abrasion (in the outer circumferential region). In view of this, the inventor considered that a polishing pad 26 that has less inner-circumferential abrasion in the polished surface could be formed by performing the same processing as above on a polishing pad 26 having inner-circumferential abrasion in the polished surface and flattening the convex portion.

Figures 1, 5:
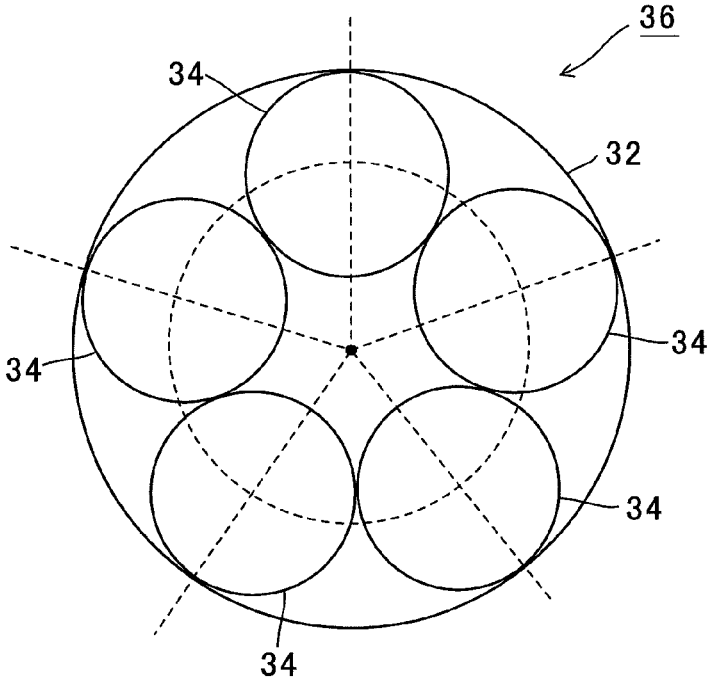
Figures 2, 5:
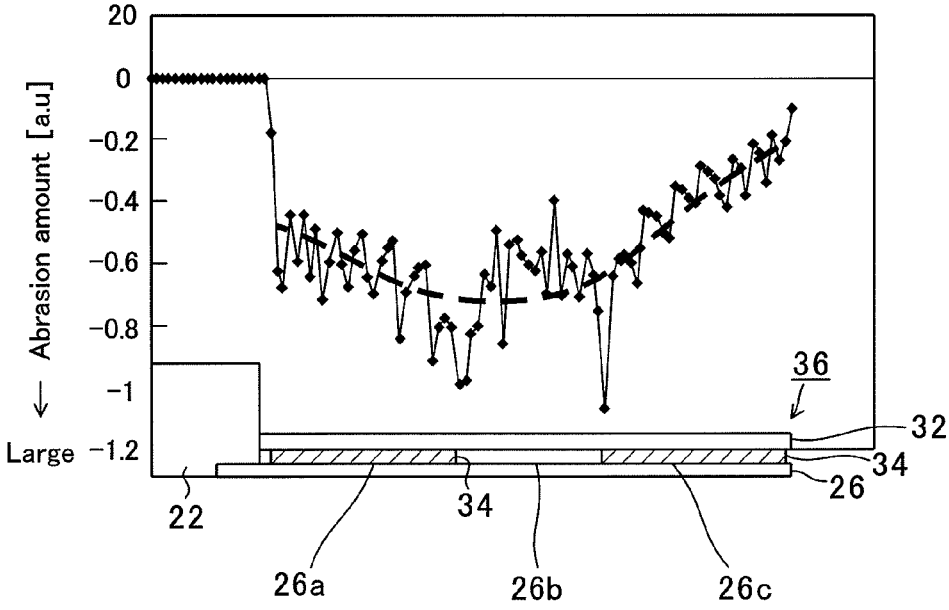

FIG. 5-1 shows the shape of a seasoning plate having conditioners attached to a ceramic plate. FIG. 5-2 shows the abrasion amount observed when a polishing pad is abraded with the seasoning plate shown in FIG. 5-1. The inventor formed a seasoning plate 36 that had five conditioners 34 attached to a round-shape ceramic plate 32 as shown in FIG. 5-1, so as to flatten the convex portions formed in the polished pad 26 due to abrasion. The seasoning plate 36 was placed on the polishing pad 26, and is rotated around the center of the ceramic plate 32 to abrade the polishing pad 26 in the same manner used for the seasoning plate 10. As shown in FIG. 5-2, it became apparent that the polishing pad 26 had the largest abrasion at the location corresponding to the position of the rotational axis of the seasoning plate 36. This is because the weight from the ceramic plate 32 is applied uniformly to the conditioners 34, and the contact area between the polishing pad 26 and the conditioners 34 becomes larger in the inner circumferential region of the rotating ceramic plate 32.

Figures 1, 6:
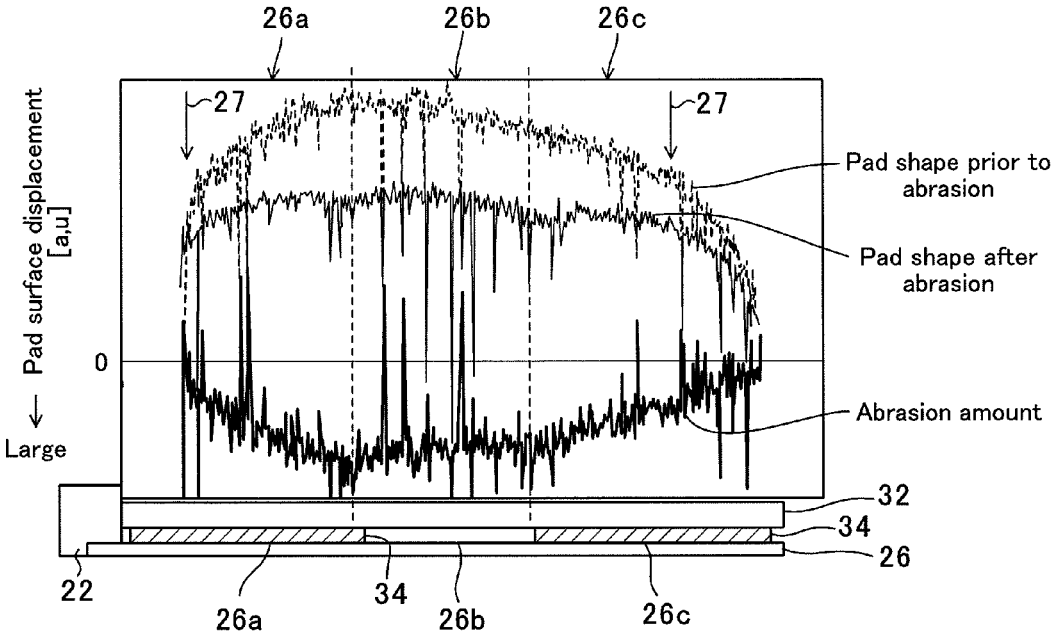
Figures 2, 6:
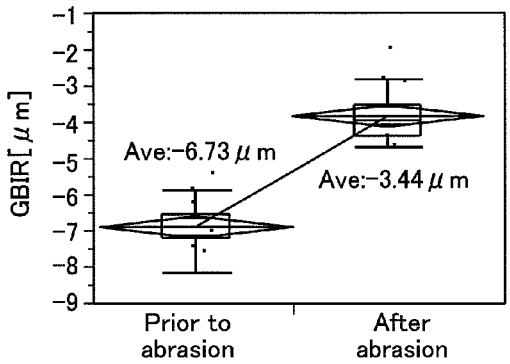
Figures 3, 6:
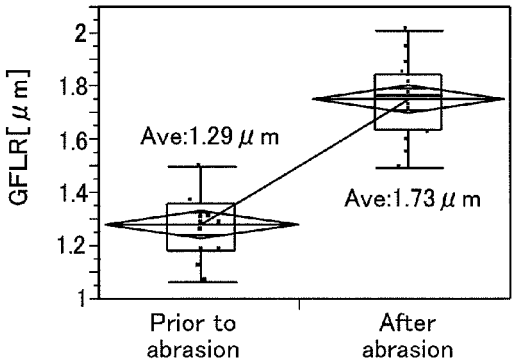

FIG. 6-1 shows the shapes of the pad surface of the polishing pad 26 observed when the polishing pad 26 is abraded with the use of the seasoning plate 36 shown in FIG. 5-1. FIG. 6-2 shows the GBIR of the surface polished with the polishing pad 26 of FIG. 6-1. FIG. 6-3 shows the GFLR of the surface polished with the polishing pad 26 of FIG. 6-1. The rotation speed of the polishing pad 26 in the process of abrading the polishing pad 26 was 45 rpm. In the polishing process, on the other hand, the rotation speed of the polishing pad 26 and the center roller 22 before and after abrasion was 21 rpm, and the polishing time was 10 minutes. The polishing pad 26 having the pad shape shown in FIG. 3-1 was used as the polishing pad (the reference polishing pad) before abrasion. As can be seen from FIG. 6-1, the convex portions of the polishing pad 26 were flattened, and not only the center region 26*b* but also the inner circumferential region 26*a* and the outer circumferential region 26*c* were abraded. As can be seen from FIG. 6-2, the mean GBIR value of the surface polished with the use of the polishing pad 26 after the abrasion by the seasoning plate 36 was higher than the mean GBIR value observed before the abrasion (increased from −6.73 μm to −3.44 μm), and accordingly, the inner-circumferential abrasion tendency of the polished surface was reduced.

However, as can be seen from FIG. 6-3, the mean value of the GFLR (Global Front Least squares Range) for evaluating the flatness of the polished surface was rather degraded, compared with the mean GFLR value observed before the abrasion, with the reference surface being the virtual polished surface (the best-fit surface) expected to have the lowest flatness of all polished surfaces. The reason for this phenomenon can be considered as follows. The convex portions of the polishing pad 26 were flattened by abrading the polishing pad 26 having the convex portions with the use of the seasoning plate 36 as shown in FIG. 6-1, and the GBIR was improved as the entire flatness became higher. However, as indicated by the arrows 27 in FIG. 6-1, two noticeable inflection points appeared in the inner circumferential region 26*a* and the outer circumferential region 26*c* of the polishing pad 26, and the shapes of the inflection points were transferred onto the polished surface. As a result, the GFLR deteriorated.

Figure 7:
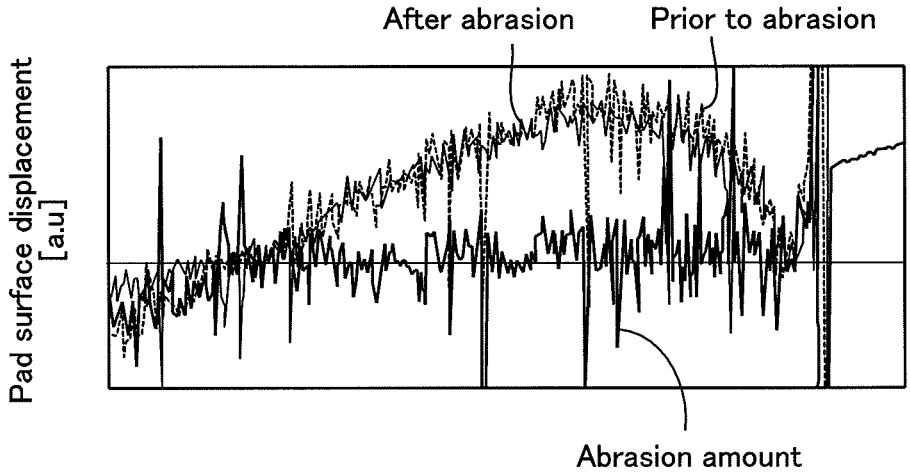
FIG. 7 shows the pad shape in the outer circumferential region of a polishing pad, with the best-fit surface in the outer circumferential region being the reference face.

FIG. 7 shows the pad shapes of the outer circumferential region 26*c* of the polishing pad 26 of FIG. 6-1 observed where the reference surface is the best-fit surface of the circumferential region 26*c*. As shown in FIG. 7, the outer circumferential region 26*c* is abraded, while maintaining a shape greatly different from the best-fit surface both before and after the abrasion of the polishing pad 26. This shape is considered as the main cause of the deterioration of the GFLR.

Figures 1, 8:
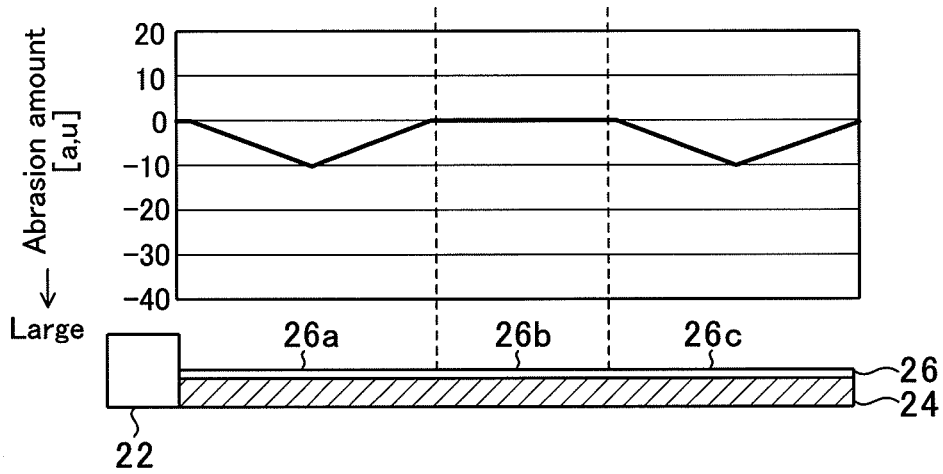
Figures 2, 8:
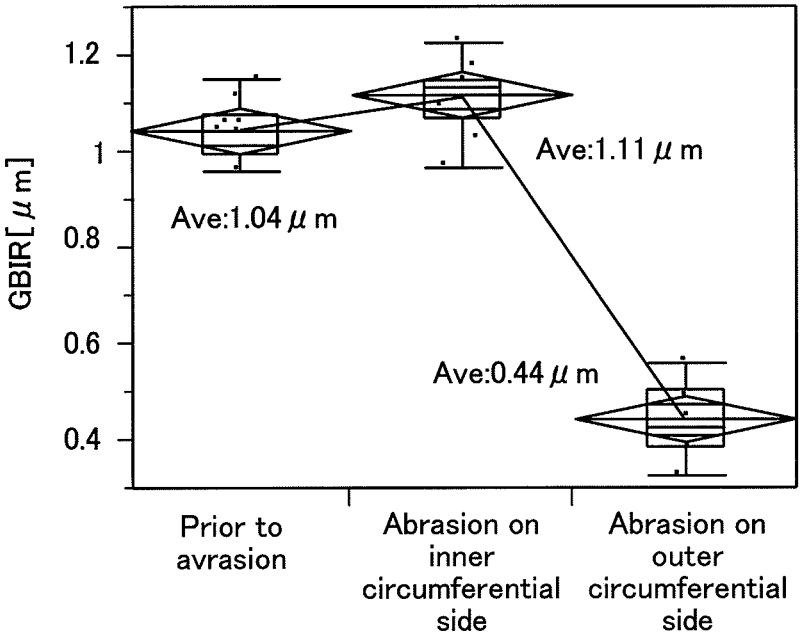

To eliminate the two inflection points (indicated by the arrows 27), the inner circumferential region 26*a* and the outer circumferential region 26*c* having the inflection points in the polishing pad 26 were selectively abraded, and the GFLR of the polished surface of the wafer polished by the abraded polishing pad 26 was measured, as shown in FIG. 8-1. In the process of abrading the polishing pad 26, the rotation speed of the polishing pad 26 was 45 rpm, and the regions having the inflection points in the polishing pad 26 were abraded. In the polishing process, on the other hand, the rotation speed of the polishing pad 26 and the center roller 22 both before and after the abrasion was 21 rpm, and the polishing time was 10 minutes. As can be seen from FIG. 8-2, there was not a large difference in the mean GFLR value when the inflection point in the inner circumferential region 26*a* was eliminated. However, when the inflection point in the outer circumferential region 26*c* was eliminated, the mean GFLR value was greatly improved (before the abrasion: 1.04 μm, after the abrasion of the inner circumferential region: 1.11 μm, after the abrasion of the outer circumferential region: 0.44 μm).

In view of the above facts, the inventor invented the seasoning plate 10 that flattens the entire polishing pad 26, and eliminates the inflection points (particularly, the inflection point in the outer circumferential region) as shown in FIGS. 1-1, 1-2, and 1-3. More specifically, the seasoning plate 10 is placed on the polishing pad 26, and performs seasoning of the polishing pad 26 by abrading the polishing pad 26 by the friction caused by the rotation of the polishing pad 26. The seasoning plate 10 includes: the conditioners 14 for abrading the polishing pad 26; the round flexible substrate 12 having the conditioners 14 attached to its bottom face; the O-ring 16 that is placed on the upper face of the flexible substrate 12 in such a manner as to form a circle concentric with the flexible substrate 12; and the weight plate 18 serving as the weight portion that is placed on the O-ring 16 and applies weight so as to deform the flexible substrate 12.

Since the polishing pad 26 is abraded in the condition that the conditioners 14 are attached to the single flexible substrate 12, the total contact area between the conditioners 14 and the center region 26*b* of the polishing pad 26 becomes larger. Accordingly, the abrasion of the center region 26*b* is also performed efficiently, and the convex portions of the pad surface can be flattened. Thus, the GBIR can be improved. Furthermore, more weight is applied to the portions of the conditioners 14 overlapping the outer circumferential region of the flexible substrate 12, with the conditioners 14 being attached to the flexible substrate 12. Accordingly, the pad-surface inflection points which may appear in the inner circumferential region 26*a* and the outer circumferential region 26*c* of the polishing pad 26 can be eliminated, and the shape of the entire pad surface is made smooth. In this manner, transfer of the inflection points onto the polished surface can be prevented, and the GFLR can be improved.

The distribution of weight applied to the conditioners 14 depends on the thickness of the flexible substrate 12, the degree of flexibility, and the diameter of the O-ring 16. For example, in a case where the thickness of the flexible substrate is small or the degree of flexibility is high, the deformation of the flexible substrate becomes larger. In this case, the weight applied to the conditioners 14 concentrates on the portion directly below the O-ring 16, and the position of the concentric weight concentrating portion varies with the diameter of the O-ring 16. In a case where the thickness of the flexible substrate 12 is large or the degree of flexibility is low, the deformation of the flexible substrate 12 is smaller. In this case, the weight applied to the conditioners 14 scatters in conformity with the shape of the concentric circle formed with the O-ring 16 (or the flexible substrate 12), with the portion immediately below the O-ring being the center. Accordingly, the three parameters should be varied so as to adjust the GBIR and GFLR of each polishing object to preferred values.

Figures 1, 9:
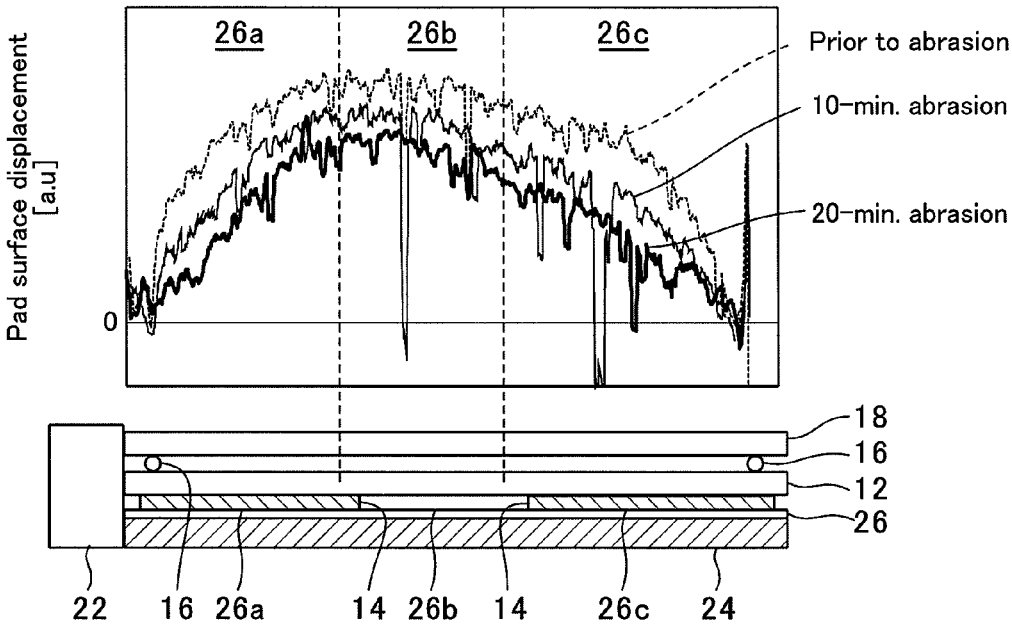
Figures 2, 9:
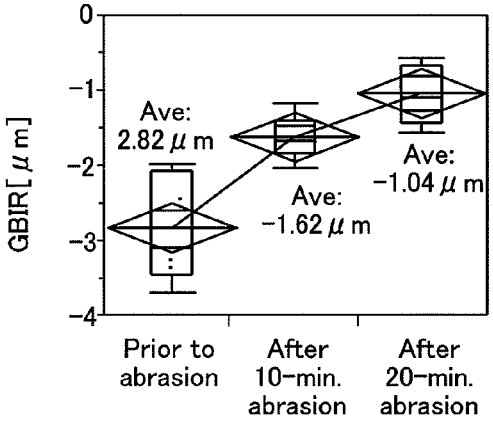
Figures 3, 9:
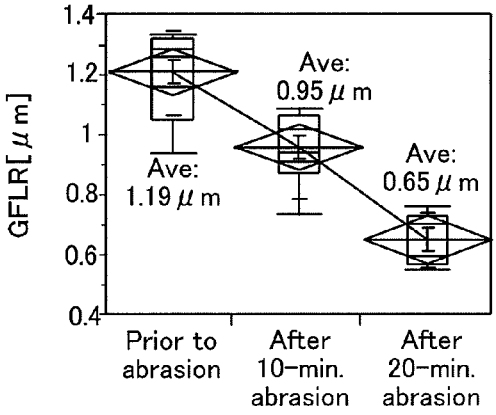
Figures 1, 10:
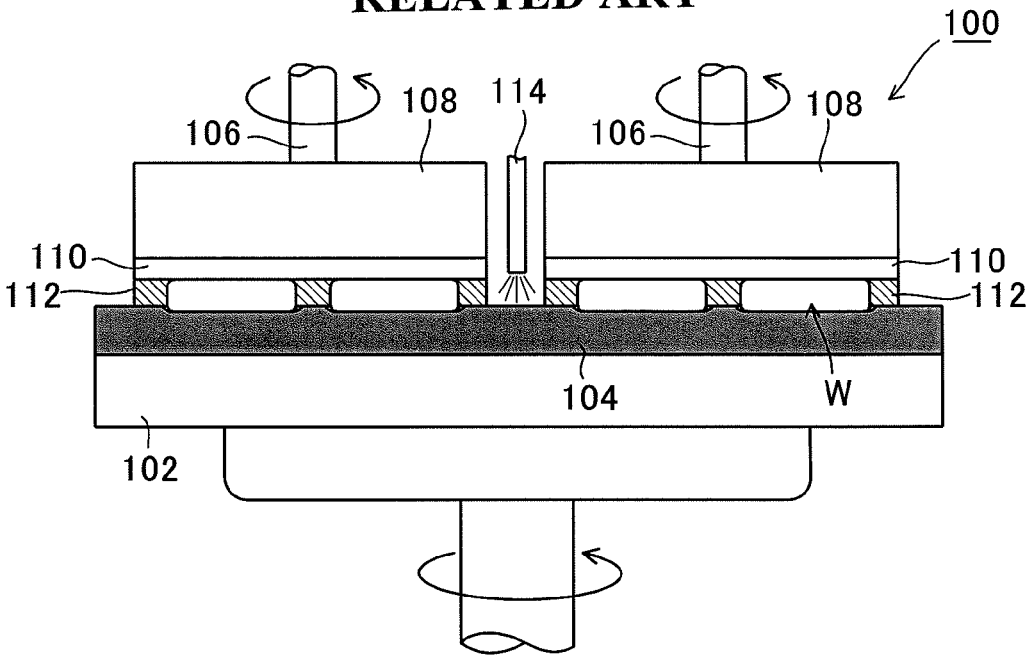
Fig.10-1 RELATED ART
Figures 2, 10:
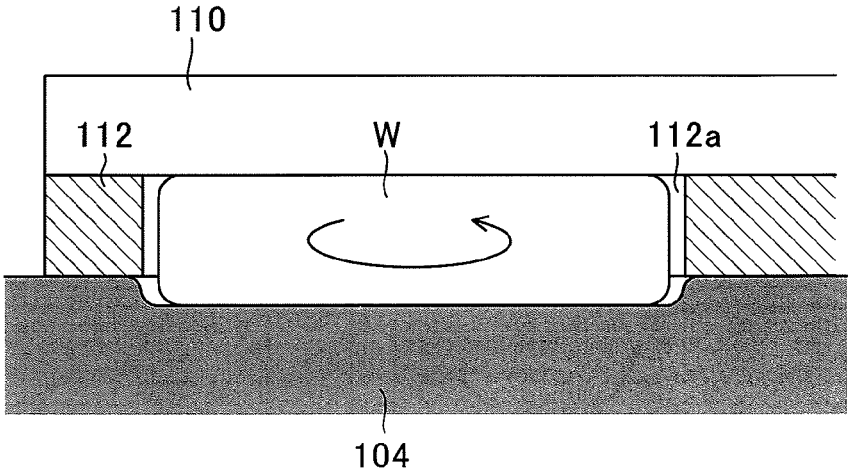
Fig.10-2 RELATED ART
Figures 1, 11:
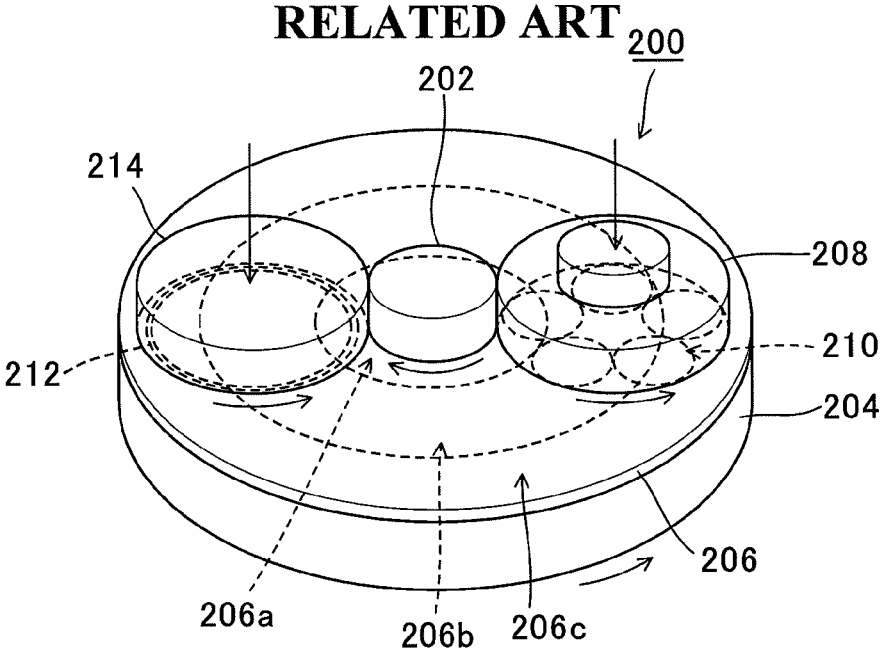
Fig.11-1 RELATED ART
Figures 2, 11:
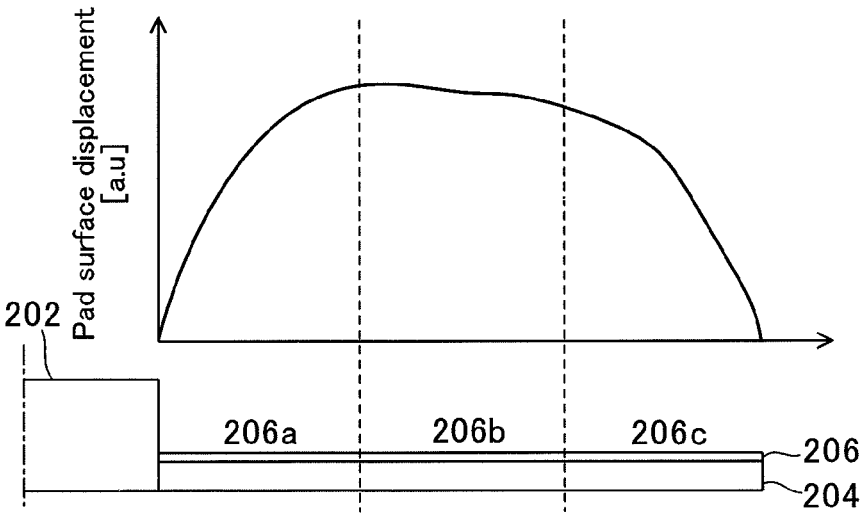
Fig.11-2 RELATED ART
Figure 12:
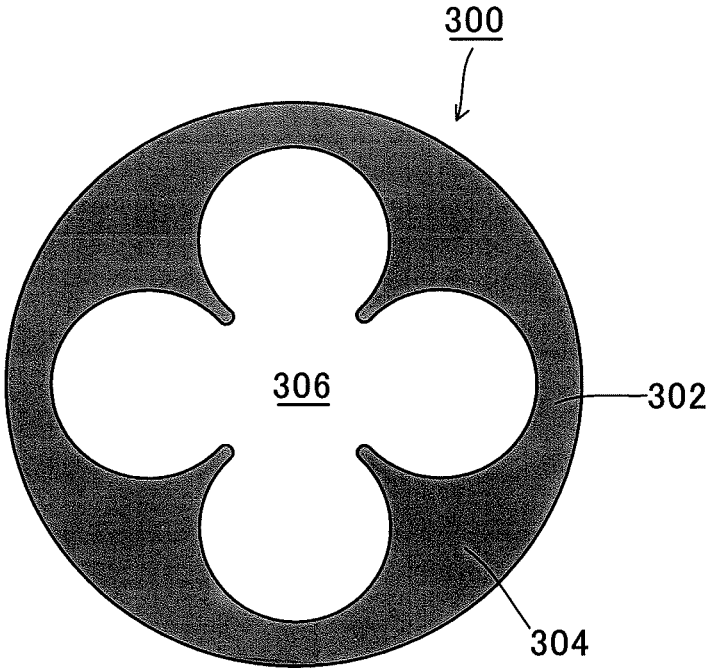
FIG. 12 is a schematic view of a conventional conditioner.

FIG. 9-1 shows the shapes of the pad surface observed when the polishing pad 26 is abraded with the use of the seasoning plate 10 according to this embodiment. FIG. 9-2 shows the GBIR of the surface polished by the polishing pad 26 of FIG. 9-1. FIG. 9-3 shows the changes in the GFLR of the surface polished by the polishing pad 26 of FIG. 9-1. In the process of abrading the polishing pad 26, the rotation speed of the polishing pad 26 and the center roller 22 was 45 rpm, and the abrasion was performed for 10 minutes in one case and 20 minutes in another. In the polishing process, on the other hand, the rotation speed of the polishing pad 26 and the center roller 22 was 21 rpm, and the polishing time was 10 minutes.

As shown in FIG. 9-1, in the entire pad surface, the convex portions are flattened as in the pad surface shape illustrated in FIG. 6-1. As can be seen from FIG. 9-1, the abrading performance of the seasoning plate 10 near the center 12*b* of the flexible substrate 12 is substantially the same as that of the seasoning plate 36 even in a case where the conditioners 14 are attached to the flexible substrate 12. Also, since the convex portions in the pad surface are flattened, the tendency represented by the GBIR value also switches from the inner abrasion to the outer abrasion, as the abrading time becomes longer, as can be seen from FIG. 9-2. Thus, the GBIR is improved. Meanwhile, as can be seen from FIG. 9-1, where the abrading time in the inner circumferential region 26*a* and the outer circumferential region 26*c* is longer, the above mentioned inflection points disappear. Accordingly, where the abrading time is longer, the GFLR value shown in FIG. 9-3 is also improved.

As described above, with the method for seasoning the polishing pad 26, the seasoning plate 10, and the semiconductor polishing device 20 according to this embodiment, the variations of abrasion depths in the inner circumferential region 26*a* and the outer circumferential region 26*c* of the polishing pad 26 can be reduced with simple structures using conventional conditioners, and the abrasion depths in the polishing pad 26 can be made more uniform. Accordingly, the flatness of the polished surface can be readily maintained by controlling the rotation speed of the polishing pad 26. Thus, the life of the polishing pad 26 in use can be prolonged, and the costs are lowered.

Since this embodiment is not affected by the shape of the polishing pad 26 before abrasion, this embodiment can be applied to cases where convex portions are already formed in the inner circumferential region 26*a* and the outer circumferential region 26*c* across the center region 26*b*, and the once-lost control of the flatness of the polished surface through the adjustment of the rotation speed of the polishing pad 26 can be resumed. In this embodiment, seasoning is performed on the polishing pad to be used for rough polishing as described above. However, this embodiment may also be applied to the seasoning of polishing pads to be used for finishing and polishing pads to be used for CMP. As described so far, this embodiment can provide a polishing pad seasoning method, a seasoning plate, and a semiconductor polishing device, with which appropriate seasoning can be performed at low cost.

The invention claimed is:

1. A polishing pad seasoning method for abrading a polishing pad by friction caused by rotation of the polishing pad, comprising:

attaching a plurality of conditioners for abrading the polishing pad to a lower face of a round flexible substrate;

placing a ring on an upper face of the flexible substrate; and applying weight to the flexible substrate via the ring and pressing the conditioners against the polishing pad to deform the flexible substrate, the ring forming a circle concentric with the flexible substrate.

2. The polishing pad seasoning method according to claim 1, wherein the conditioners are arranged in such a manner that centers of the conditioners form a circle concentric with the flexible substrate.

3. The polishing pad seasoning method according to claim 1, wherein grooves extending along radial lines extending from a center of each of the conditioners are formed in a surface of each of the conditioners, the surface being in contact with the polishing pad.

4. A polishing pad seasoning method for abrading a polishing pad by friction caused by rotation of the polishing pad, comprising:

attaching a plurality of conditioners for abrading the polishing pad to a lower face of a round flexible substrate;

mounting a weight portion on an upper face of the flexible substrate, to press the conditioners against the polishing pad;

placing a ring between the flexible substrate and the weight portion; and applying weight to the flexible substrate via the ring placed between the flexible substrate and the weight portion, to deform the flexible substrate and eliminate inflection points in a pad surface of the polishing pad, the inflection points appearing during the abrasion of the polishing pad by the conditioners, and the ring forming a circle concentric with the flexible substrate.

5. The polishing pad seasoning method according to claim 4, wherein the conditioners are arranged in such a manner that centers of the conditioners form a circle concentric with the flexible substrate, and the polishing pad is abraded most at the center of the circle.

6. A seasoning plate that is placed on a polishing pad and performs seasoning of the polishing pad by abrading the polishing pad through friction caused by rotation of the polishing pad, comprising:

a plurality of conditioners that abrade the polishing pad;

a round flexible substrate that has the conditioners attached to a lower face thereof;

a ring that is placed on an upper face of the flexible substrate, the ring forming a circle concentric with the flexible substrate; and a weight portion that is placed on the ring and applies weight for deforming the flexible substrate.

7. The seasoning plate according to claim 6, wherein the conditioners are arranged in such a manner that centers of the conditioners form a circle concentric with the flexible substrate.

8. The seasoning plate according to claim 6, wherein grooves extending along radial lines extending from a center of each of the conditioners are formed in a surface of each of the conditioners, the surface being in contact with the polishing pad.

9. The seasoning plate according to claim 6, wherein a material of the flexible substrate is polyvinyl chloride.

10. The seasoning plate according to claim 6, wherein a material of the ring is silicon rubber or resin.

11. A seasoning plate that is placed on a polishing pad and performs seasoning of the polishing pad by abrading the polishing pad through friction caused by rotation of the polishing pad, comprising:

a plurality of conditioners that abrade the polishing pad;

a round flexible substrate that has the conditioners attached to a lower face thereof;

a weight portion that applies weight to the flexible substrate; and a ring that is placed between the flexible substrate and the weight portion, and applies weight for deforming the flexible substrate to the flexible substrate, the ring forming a circle concentric with the flexible substrate, the ring eliminating inflection points in a pad surface of the polishing pad, the inflection points appearing during the abrasion of the polishing pad by the conditioners.

12. A seasoning plate that is placed on a polishing pad and performs seasoning of the polishing pad by abrading the polishing pad through friction caused by rotation of the polishing pad, comprising:

a plurality of conditioners that abrade the polishing pad;

a round flexible substrate that is made of polyvinyl chloride and has the conditioners attached to a lower face thereof;

grooves that extend along radial lines extending from a center of each of the conditioners, and are formed in a surface of each of the conditioners, the surface being in contact with the polishing pad;

a ring that is made of silicon rubber or resin, and is placed on an upper face of the flexible substrate, the ring forming a circle concentric with the flexible substrate; and a weight portion that is placed on the ring and applies weight for deforming the flexible substrate.

13. The seasoning plate according to claim 12, wherein the conditioners are arranged in such a manner that centers of the conditioners form a circle concentric with the flexible substrate.

14. A seasoning plate that is placed on a polishing pad and performs seasoning of the polishing pad by abrading the polishing pad through friction caused by rotation of the polishing pad, comprising:

a plurality of conditioners that abrade the polishing pad;

a round flexible substrate that is made of polyvinyl chloride and has the conditioners attached to a lower face thereof;

grooves that extend along radial lines extending from a center of each of the conditioners, and are formed in a surface of each of the conditioners, the surface being in contact with the polishing pad;

a weight portion that applies weight to the flexible substrate; and a ring that is made of silicon rubber or resin, and is placed between the flexible substrate and the weight portion, the ring forming a circle concentric with the flexible substrate, the ring applying weight for deforming the flexible substrate to the flexible substrate, the ring eliminating inflection points in a pad surface of the polishing pad, the inflection points appearing during the abrasion of the polishing pad by the conditioners.

15. A semiconductor polishing device on which a seasoning plate is mounted, the seasoning plate being placed on a polishing pad and performing seasoning of the polishing pad by abrading the polishing pad through friction caused by rotation of the polishing pad, the seasoning plate comprising:

a plurality of conditioners that abrade the polishing pad;

a round flexible substrate that has the conditioners attached to a lower face thereof;

a ring that is placed on an upper face of the flexible substrate, the ring forming a circle concentric with the flexible substrate; and a weight portion that is placed on the ring and applies weight for deforming the flexible substrate.

16. The semiconductor polishing device according to claim 15, wherein the conditioners are arranged in such a manner that centers of the conditioners form a circle concentric with the flexible substrate.

17. The semiconductor polishing device according to claim 15, wherein grooves extending along radial lines extending from a center of each of the conditioners are formed in a surface of each of the conditioners, the surface being in contact with the polishing pad.

18. The semiconductor polishing device according to claim 15, wherein a material of the flexible substrate is polyvinyl chloride.

19. The semiconductor polishing device according to claim 15, wherein a material of the ring is silicon rubber or resin.

20. A semiconductor polishing device on which a seasoning plate is mounted, the seasoning plate being placed on a polishing pad and performing seasoning of the polishing pad by abrading the polishing pad through friction caused by rotation of the polishing pad, the seasoning plate comprising:

a plurality of conditioners that abrade the polishing pad;

a round flexible substrate that has the conditioners attached to a lower face thereof;

a weight portion that applies weight to the flexible substrate; and a ring that is placed between the flexible substrate and the weight portion, and applies weight for deforming the flexible substrate to the flexible substrate, the ring forming a circle concentric with the flexible substrate, the ring eliminating inflection points in a pad surface of the polishing pad, the inflection points appearing during the abrasion of the polishing pad by the conditioners.

21. A semiconductor polishing device on which a seasoning plate is mounted, the seasoning plate being placed on a polishing pad and performing seasoning of the polishing pad by abrading the polishing pad through friction caused by rotation of the polishing pad, the seasoning plate comprising:

a plurality of conditioners that abrade the polishing pad;

a round flexible substrate that is made of polyvinyl chloride and has the conditioners attached to a lower face thereof;

grooves that extend along radial lines extending from a center of each of the conditioners, and are formed in a surface of each of the conditioners, the surface being in contact with the polishing pad;

a ring that is made of silicon rubber or resin, and is placed on an upper face of the flexible substrate, the ring forming a circle concentric with the flexible substrate; and a weight portion that is placed on the ring and applies weight for deforming the flexible substrate.

22. The semiconductor polishing device according to claim 21, wherein the conditioners are arranged in such a manner that centers of the conditioners form a circle concentric with the flexible substrate.

23. A semiconductor polishing device on which a seasoning plate is mounted, the seasoning plate being placed on a polishing pad and performing seasoning of the polishing pad by abrading the polishing pad through friction caused by rotation of the polishing pad, the seasoning plate comprising:

a plurality of conditioners that abrade the polishing pad;

a round flexible substrate that is made of polyvinyl chloride and has the conditioners attached to a lower face thereof;

grooves that extend along radial lines extending from a center of each of the conditioners, and are formed in a surface of each of the conditioners, the surface being in contact with the polishing pad;

a weight portion that applies weight to the flexible substrate; and a ring that is made of silicon rubber or resin, and is placed between the flexible substrate and the weight portion, the ring forming a circle concentric with the flexible substrate, the ring applying weight for deforming the flexible substrate to the flexible substrate, the ring eliminating inflection points in a pad surface of the polishing pad, the inflection points appearing during the abrasion of the polishing pad by the conditioners.

* * * * *